US010507946B2

(12) United States Patent
Jelken et al.

(10) Patent No.: US 10,507,946 B2
(45) Date of Patent: Dec. 17, 2019

(54) PRODUCTION AND PACKAGING INSTALLATION FOR HYGIENE PRODUCTS, AND METHOD FOR OPERATING THE SAME

(71) Applicant: Focke & Co. (GmbH & Co. KG), Verden (DE)

(72) Inventors: Andreas Jelken, Barssel (DE); Marco Schloermann, Neukamperfehn (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 433 days.

(21) Appl. No.: 14/419,436

(22) PCT Filed: Aug. 8, 2013

(86) PCT No.: PCT/EP2013/002370

§ 371 (c)(1),
(2) Date: Feb. 3, 2015

(87) PCT Pub. No.: WO2014/023428

PCT Pub. Date: Feb. 13, 2014

(65) Prior Publication Data

US 2015/0225100 A1 Aug. 13, 2015

(30) Foreign Application Priority Data

Aug. 10, 2012 (DE) ..... 10 2012 015 820

(51) Int. Cl.
*B65B 57/14* (2006.01)
*B65B 5/06* (2006.01)
*B65B 35/30* (2006.01)

(52) U.S. Cl.
CPC ..... *B65B 57/14* (2013.01); *B65B 5/067* (2013.01); *B65B 35/30* (2013.01)

(58) Field of Classification Search
USPC ..... 53/443, 495
See application file for complete search history.

(56) References Cited

U.S. PATENT DOCUMENTS 3,593,837 A * 7/1971 Loomis, Jr. ..... B65B 35/30 53/537
4,974,391 A * 12/1990 Blum ..... B65B 5/068 53/69

(Continued)

FOREIGN PATENT DOCUMENTS

DE 69908370 T2 3/2004
DE 69819955 T2 9/2004

(Continued)

OTHER PUBLICATIONS

Deutsches Patent—Und Markenmt, Recherchebericht (search report in priority application), dated Mar. 6, 2013.

(Continued)

*Primary Examiner* — Michelle Lopez
*Assistant Examiner* — Chinyere J Rushing-Tucker
(74) *Attorney, Agent, or Firm* — Laurence P. Colton; Smith Tempel Blaha LLC

(57) ABSTRACT

A method for operating a production and packaging installation for hygiene products, wherein the hygiene products are produced by a production machine, and the hygiene products produced are packaged by at least two packaging machines which are assigned to the production machine and are intended for packaging the hygiene products in particular so that they are ready for dispatch. At least two packaging machines assigned to a grouping conveyor form a machine group, wherein the performance of the packaging machines of the machine group are adapted automatically in accordance with the performance of the production machine and/or the individual performances available for the packaging machines of the machine group, and/or wherein the (Continued)

number of hygiene products with which the holders of the grouping conveyor are filled is selected automatically for each holder in dependence on which of the packaging machines the hygiene product of the respective holder is intended.

16 Claims, 4 Drawing Sheets

(56) References Cited

U.S. PATENT DOCUMENTS

| | | | | | |
|---|---|---|---|---|---|
| 5,127,209 | A * | 7/1992 | Hunter | B65B 35/44 | 198/419.3 |
| 5,897,291 | A * | 4/1999 | Gerwe | B65B 35/24 | 414/790.7 |
| 5,897,292 | A * | 4/1999 | Gerwe | B65G 47/082 | 414/798.4 |
| 5,996,316 | A * | 12/1999 | Kirschner | B65G 1/1378 | 53/155 |
| 2001/0042359 | A1* | 11/2001 | Franzaroli | B65B 25/146 | 53/435 |
| 2003/0079961 | A1* | 5/2003 | Dennert | B65G 47/082 | 198/429 |
| 2005/0055988 | A1* | 3/2005 | Escobar | B65B 5/08 | 53/540 |
| 2008/0216451 | A1* | 9/2008 | Stafford | B65B 5/10 | 53/445 |
| 2009/0287330 | A1* | 11/2009 | Overley | G05B 19/41865 | 700/96 |
| 2010/0071318 | A1* | 3/2010 | Brandhorst | B65B 35/54 | 53/446 |
| 2010/0138035 | A1* | 6/2010 | Fecht | B65B 35/44 | 700/228 |
| 2013/0068590 | A1* | 3/2013 | Fujita | B65G 47/841 | 198/426 |
| 2015/0203231 | A1* | 7/2015 | Brandhorst | B65B 35/40 | 100/35 |
| 2016/0075459 | A1* | 3/2016 | Brandhorst | B65B 19/34 | 53/444 |
| 2016/0083129 | A1* | 3/2016 | Prahm | B65B 43/56 | 53/475 |

FOREIGN PATENT DOCUMENTS

| | | | |
|---|---|---|---|
| DE | 69730942 | T2 | 10/2005 |
| DE | 60112979 | T2 | 5/2006 |
| DE | 102010053040 | A1 | 6/2012 |
| EP | 0654408 | A1 | 5/1995 |
| EP | 1127791 | A1 | 8/2001 |

OTHER PUBLICATIONS

WIPO, Internationaler Recherchenbericht (International Search Report for priority application), dated Apr. 23, 2014.

Mexico Patent Office, translation of office action on related application.

* cited by examiner

PRODUCTION AND PACKAGING INSTALLATION FOR HYGIENE PRODUCTS, AND METHOD FOR OPERATING THE SAME

STATEMENT OF RELATED APPLICATIONS

The application is the US PCT National Phase of International Application No. PCT/EP2013/002370 having an International Filing Date of 8 Aug. 2013, which claims priority on German Patent Application No. 10 2012 015 820.3 having a filing date of 10 Aug. 2012.

BACKGROUND OF THE INVENTION

Technical Field

The present invention relates to a method for operating a production and packaging installation for hygiene products, such as diapers, sanitary napkins or the like, and to a production and packaging installation for hygiene products, such as diapers, sanitary napkins or the like.

Prior Art

Developments in recent years have led to the performances of production machines which are intended for producing hygiene products, and are used in a corresponding production line, advancing more and more. Accordingly, the performance of the packaging machine, which follows in the production process, has to keep pace, so that the products produced can be processed at the predetermined speed. As an alternative to this, the prior art, albeit only very infrequently up until now, has taken steps to use in each case two identical packaging machines in a production line. In other words, in the case of this concept, a production machine is assigned two packaging machines. In the prior art here, the number of hygiene products produced is split in half, following a fixed pattern, between the identical packaging machines. The packaging machines are arranged along a conveying path of a cyclically moving grouping conveyor which receives products coming from the production machine and has a plurality of holders or compartments for the products. Each holder of the grouping conveyor is filled with an unalterable number of hygiene products which is stipulated prior to the beginning of production. The products are then fed from the holders, following a fixed pattern, either to one packaging machine or to the other.

It is disadvantageous here, inter alia, that the two machines can produce only respectively identical sizes of multipack or packs with in each case an identical number of products contained therein. Also disadvantageous is the fact that the entire installation comes to a standstill as soon as one of the two packaging machines fails.

BRIEF SUMMARY OF THE INVENTION

Taking this as a departure point, it is an object of the invention to develop further a method of the type mentioned in the introduction for operating a production and packaging installation for hygiene products and also a corresponding installation.

This object is achieved by a method for operating a production and packaging installation for hygiene products, such as diapers, sanitary napkins or the like, in the case of which the hygiene products are produced by a unit for producing the same—production machine—and the hygiene products produced are packaged by at least two units which are assigned to the production machine and are intended for packaging the hygiene products in particular so that they are ready for dispatch—packaging machine—, wherein, prior to the packaging operation, the hygiene products produced by the production machine are supplied individually, and one after the other, to a preferably continuously circulating grouping conveyor which has individual holders for the hygiene products and to which the at least two packaging machines are assigned, wherein the individual holders are filled in each case with a hygiene product or, so as to form a hygiene-product group, in each case with a plurality of hygiene products, and wherein the individual hygiene product or the hygiene-product group of each holder is then removed from the respective holder of the grouping conveyor and supplied to one of the packaging machines which is assigned to the grouping conveyor and then packages the hygiene product/the hygiene-product group, preferably together with one or more hygiene products/hygiene-product groups from one or more further holders, into a suitable pack, in particular into a bag or a folding box or the like, and by a production and packaging installation for hygiene products, such as diapers, sanitary napkins or the like, in particular for implementing the method of the invention, having a unit for producing the hygiene products—production machine—and at least two units for packaging the hygiene products in particular so that they are ready for dispatch—packaging machine —, having a preferably continuously circulating grouping conveyor which has individual holders for the hygiene products and to which the at least two packaging machines are assigned, and to which the hygiene products produced by the production machine can be supplied individually, and one after the other, prior to the packaging operation, wherein the individual holders can be filled in each case with a hygiene product or, so as to form a hygiene-product group, in each case with a plurality of hygiene products, and wherein the individual hygiene product or the hygiene-product group of each holder can then be removed from the respective holder of the grouping conveyor and supplied to one of the packaging machines which is assigned to the grouping conveyor and by means of which the hygiene product/the hygiene-product group can then be packaged, preferably together with one or more hygiene products/hygiene-product groups from one or more further holders, into a suitable pack, in particular into a bag or a folding box or the like.

In the case of the method according to the invention for operating a production and packaging installation for hygiene products, in particular the same kinds of hygiene products are produced by a unit for producing the same—production machine—and the hygiene products produced are subsequently packaged by at least two units which are assigned to the production machine and are intended for packaging the hygiene products—packaging machine. Packaging can take place here in particular so that the hygiene products are ready for dispatch.

Prior to the packaging operation, the hygiene products produced by the production machine are supplied individually, and one after the other, to a preferably continuously circulating grouping conveyor which has individual holders or compartments for the hygiene products and to which the at least two packaging machines are assigned. The individual holders are filled in each case usually so as to form a product group with a plurality of hygiene products, for example with two, three or four products. In principle, however, it is also conceivable, at least in theory, for one, more or all of the holders to be filled with just one hygiene product.

The individual hygiene product or the hygiene-product group of each holder is then removed from the respective holder of the conveyor and supplied to one of the packaging machines which is assigned to the grouping conveyor. Removal takes place preferably by means of a suitable removal apparatus, for example a pushing-out mechanism, which removes the products from the holders.

The corresponding machine then packages the hygiene product/the hygiene-product group of the holder into a suitable pack, usually together with one or more hygiene products/hygiene-product groups from one or more further holders of the grouping conveyor. Such a pack may be a bag or a folding box or the like.

Provision is made, then, according to the invention for at least two of the packaging machines assigned to the grouping conveyor to form, at a control level, a machine group. It is usually the case here that all the associated packaging machines will be part of the machine group, but this need not be so.

According to the invention, the number of hygiene products with which the individual holders of the endless conveyor are filled in each case is selected automatically for each holder in dependence on which of the packaging machines of the machine group the hygiene product or the hygiene-product group of the respective holder is intended for.

In other words, during the production process, it is stipulated automatically and individually for each holder which packaging machine the product or the product group which is located in the holder is fed to. Also stipulated individually for each holder is the number of products which is introduced into the holder. These measures make it possible to predetermine for the grouping conveyor a variable filling operation which is coordinated individually with the individual packaging machines, and/or with the packaging products which can be produced thereby, or to predetermine a plan for filling the hygiene products and to fill the grouping conveyor in accordance with the filling operation or in accordance with the filling plan.

It is thus possible, during the production process, for example first of all for a certain number of holders of the grouping conveyor to be filled with hygiene products which are intended for a first packaging machine. A certain number of holders of the grouping conveyor which follow immediately in the conveying process, and are intended for example for a second packaging machine, can then be filled in each case with other quantities of hygiene product, etc.

It is thus possible to use one and the same production line within the same production and packaging process to package different sizes of multipack or different packs each with different numbers of products in possibly, but not necessarily, different packaging machines.

At least one packaging machine of the machine group can thus package the hygiene products into packs which, in respect of the number of hygiene products contained therein, differ from the packs of at least one other packaging machine of the machine group.

Prior to the filling operation, it is preferred for each holder of the grouping conveyor to be clearly assigned automatically in each case to one of the packaging machines of the machine group such that the hygiene product located in the corresponding holder, or the hygiene-product group located therein, is clearly intended for the associated packaging machine of the machine group and is subsequently fed, correspondingly, automatically to said associated packaging machine. This assigning/associating task is performed by the control means, in particular a central control means of the production and packaging installation or possibly also one of the control means assigned to the individual machines, for example the control means of the production machine.

It is preferred here for the individual holders to be assigned in each case to individual registers in the control means. In addition, the holders are preferably assigned, in control terms, in each case to one of the packaging machines or to an individual identifier of one of the packaging machines. The holders and, correspondingly, the products contained therein are then tracked further in the control means as the conveying movement of the grouping conveyor progresses.

As already indicated above, it is possible, during the operation of filling the holders of the grouping conveyor, for a number of hygiene products provided for a certain pack which is to be produced to be divided up automatically, in particular into sub-groups, between a plurality of holders. The operations of dividing up the hygiene products between the individual holders can differ in dependence on the number of hygiene products subsequently contained in the respective pack.

In the event of a packaging machine failing, each of the holders assigned to the failed packaging machine is preferably assigned, automatically, in the control means of the machine group, to another packaging machine of the machine group.

Provision may be made here for hygiene products or hygiene-product groups which, in the event of the packaging machine failing, are located in holders still currently assigned to said packaging machine are fed automatically to another packaging machine. The proviso here is that the number of hygiene products located in said holders is suitable for being packaged properly by the other packaging machine.

In a further variant of the invention, preferably the current production or packaging performances of the packaging machines of the above-defined machine group, or the corresponding values of the same, are adapted automatically in each case, by a control device of the production and packaging installation, in accordance with the in particular current performance value of the production machine and/or in accordance with the individual performance values, in particular those currently available in each case, for the packaging machines of the machine group.

It should be mentioned here, by way of clarification, that the phrasing 'and/or' both in the patent claims and in the description, is an abbreviation used to describe the two alternatives 'and' and 'or' in the sense of the logic operation 'and' or 'or'.

This variant of the invention has, inter alia, the particular advantage that it is automatically possible, for example when the performance of the production machine increases, for the corresponding performance values of the packaging machine also to be increased. The same applies to a reduction in performance of the production machine. It is also possible for the performance values of the individual packaging machines to be adapted individually, obviously within the limits in which such performance adaptation is possible within the minimum and maximum performance limits of the machines.

For example for the case where the current performance value of a packaging machine of the machine group has been, or is being, reduced, in particular to zero, in particular on account of a fault or of a failure, it is preferably the case that the respective performance value of one or any other packaging machine of the machine group is increased automatically in order to compensate for the performance failure.

Provision may also be made, during normal operation of the packaging machines of the machine group, for the respective performance values thereof to be adjusted automatically, in accordance with the set performance of the production machine, to the respectively smallest possible value at which it is ensured that all of the hygiene products produced by the production machine can be packaged properly by the packaging machines assigned to the grouping conveyor.

In a further embodiment of the invention, for the case where the maximum-adjustment performance values of the packaging machines assigned to the grouping conveyor are insufficient for packaging all of the hygiene products which come from the production machine at the set performance value of the production machine, the performance value of the production machine is reduced automatically to a value at which all the hygiene products produced can be packaged. It is preferred here for the performance value to be reduced to the largest possible value at which the aforementioned condition is met.

Within the context of realizing the invention, it is preferably the case that the current or the actual performance values of the individual packaging machines of the machine group and the current or actual performance values of the production machine are sensed and communicated to a central control device of the installation. In dependence on the values sensed, the central control device can then determine specified performance values for the individual packaging machines of the machine group and/or the production machine.

The specified performance values for the aforementioned machines can then be communicated for example in each case to local machine-control means, which are assigned in each case to the individual packaging machines and the production machine.

BRIEF DESCRIPTION OF THE DRAWINGS

Further features of the present invention can be gathered from the attached patent claims, from the following description of a preferred exemplary embodiment of the invention and from the attached drawings, in which:

DETAILED DESCRIPTION OF PREFERRED EMBODIMENTS

Figure 1:
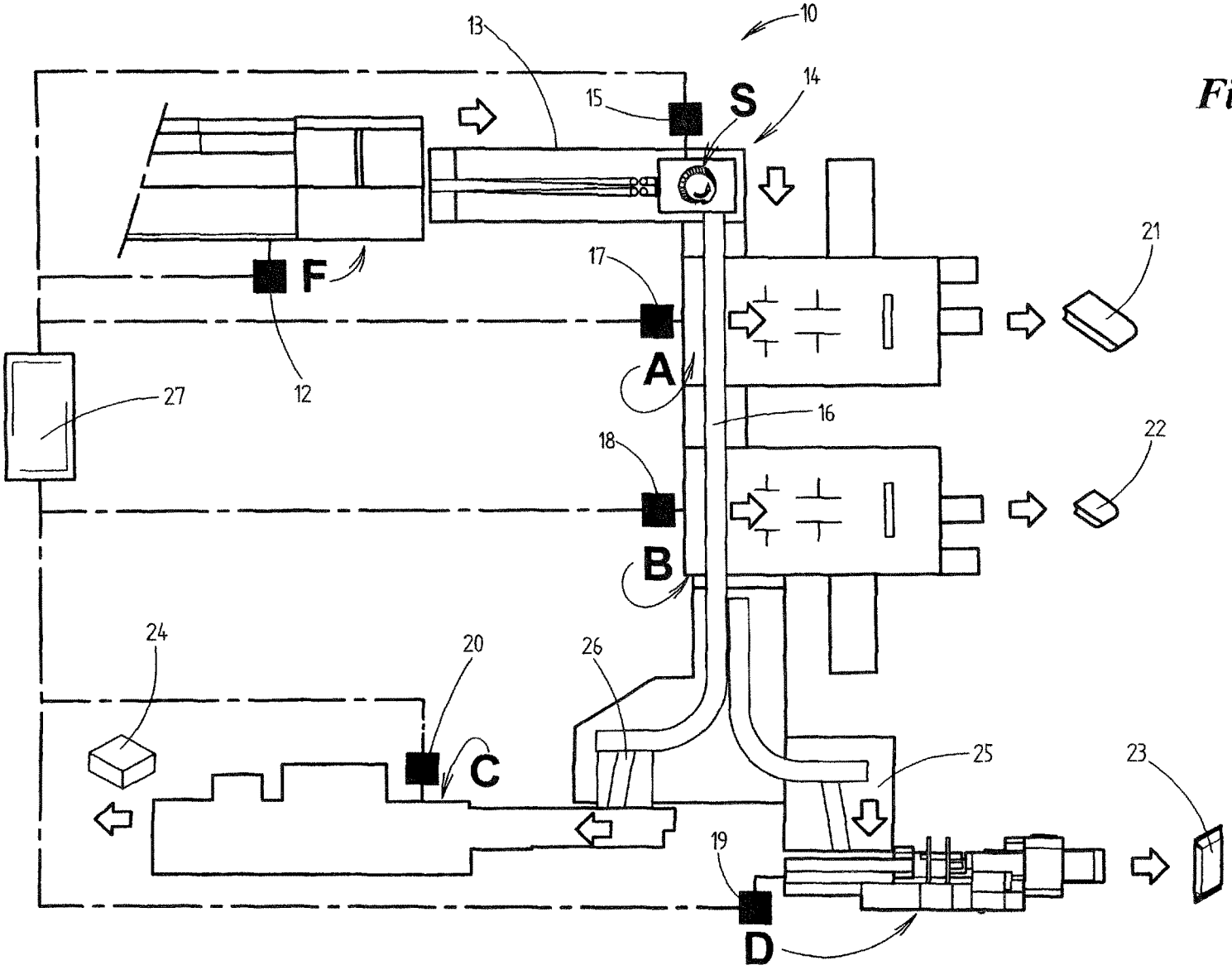
FIG. 1 shows a simplified schematic diagram of a production and packaging installation for hygiene products.

The drawings deal with the operation and/or the control of a production and packaging installation 10 for hygiene products 11. The hygiene products 11 may be, for example, diapers or so-called sanitary napkins. These items are usually of comparatively flat design and have a more or less rectangular contour.

The hygiene products 11 are produced by means of a known production machine F (converter) and supplied individually, and one after the other, to a filling station 14 via a first supply conveyor 13. A filling mechanism S, in the present case so-called cone stacker, is arranged in the region of the filling station 14. The same kinds of hygiene products 11, which come from the first supply conveyor 13, are fed individually to a grouping conveyor 16 by means of the filling mechanism S. To be more precise, the filling mechanism S fills individual holders or compartments of the grouping conveyor 16 with one or more hygiene products 11.

For this purpose, the grouping conveyor 16 is designed in the form of a compartmentalized conveyor which is known per se, that is to say in the form of a motor-driven endless conveyor with a circulating conveying strand on which are arranged, one after the other in the conveying direction, a multiplicity of individual compartments or holders for the hygiene products 11. Such compartmentalized conveyors are known and described, for example, in DE 10 2010 053 040, the disclosure of which is hereby integrated in full in the present application.

Holders of the grouping conveyor 16 which are located in the region of the filling station 14 are filled with hygiene products 11 in each case by the filling mechanism S. The filling mechanism S here fills the holders either with an individual hygiene product 11 or, at intervals,—so as to form hygiene-product groups in each case—with a plurality of hygiene products 11.

Following the operation of filling the corresponding holders, the conveying strand of the grouping conveyor 16 is moved onward until the filled holders pass into the region of unloading stations of in the present case four packaging machines A, B, C, D arranged along the conveying path of the grouping conveyor 16.

Prior to the filling operation, each of the holders of the grouping conveyor 16 has already been clearly assigned in each case, in the control means, to one of the packaging machines A-D. This will be explained in more detail hereinbelow. As soon as the filled holders each pass into the region of the respective unloading station of the packaging machine A-D assigned to them in each case, the hygiene products 11 located in the holders are conveyed out of the associated holders, by means of a suitable removal device, and packaged in the corresponding packaging machine A-D assigned to the holders.

The packaging machines A, B from FIG. 1 are bag packers (baggers), which each package a predetermined number of hygiene products 11 into bags 21 and bags 22, respectively. As can be seen in FIG. 1, the bags 21, which are produced by the packaging machine A, are packaging units which are larger than the bags 22, which are produced by the packaging machine B. The packs 21 contain a larger number of hygiene products 11 than the packs 22. In other words, the multipacks 21 are larger than the multipacks 22.

The packaging machine D (flow wrapper), which is arranged downstream of the packaging machines A, B, packages a certain number of hygiene products 11 into so-called tubular-bag packs 23 (flow packs).

The fourth packaging machine C in turn, this likewise being arranged downstream of the packaging machine A, B, is a folding-box packer, which packages the hygiene products 11 into packs 24, namely folding boxes.

The packaging machines C, D are each assigned, in a manner which is known per se, compressing devices 25, 26, by means of which the hygiene products 11 coming from the grouping conveyor 16 are first of all compressed, before being packaged in the packaging machines C, D.

The production and packaging installation 10, for the purpose of controlling the production and packaging processes, which will be described in more detail hereinbelow, is assigned a central control device 27. Said central control device 27 is assigned respectively local control means 12, 15, 17-20 via corresponding control lines. It is therefore the case that the local control unit 12 is assigned to the production machine F, the local control unit 15 is assigned to the filling mechanism S, the local control unit 17 is assigned to the packaging machine A, the local control unit 18 is assigned to the packaging machine B, the local control unit 19 is assigned to the packaging machine D and the local control unit 20 is assigned to the packaging machine C.

The respective local control units 12, 15, 17-20 transmit data from the respectively associated machine A-D, F, or the respectively associated mechanism S, to the central control device 27. The latter processes the information, calculates control data and transmits said data back to the local control units.

The data which the local control units 12, 15, 17-20 transmit may be, for example, current production data of the associated machine/of the associated mechanism A-D, F, S, for example current performance values, or information relating to faults in the machine/in the mechanism, etc.

The data which the central control device 27 transmits back to the local control means 12, 15, 17-20 may comprise, for example, specified values for the respective machine/the respective mechanism A-D, F, S, for example specified performance values, or information relating to the assignment of the individual holders of the grouping conveyor 16 to the individual packaging machines A-D, etc.

Control of the production and packaging installation 10 takes place in a specific manner. Either all of the packaging machines A-D assigned to the installation or merely a selection of said machines, for example the two machines A, B, form, at a control level, a machine group. It will be assumed hereinbelow that all of the machines A-D form the machine group.

According to a particular aspect of the control means of the installation 10, the number of hygiene products 11 with which the individual holders of the grouping conveyor 16 are filled in the region of the filling station 14 is selected automatically for each of the holders in dependence on which of the packaging machines A-D of the machine group the hygiene product 11 which is to be introduced in each case into the holder is intended for or, for the case where a plurality of products 11 are to be introduced as a product group in a holder, on which machine A-D the respective hygiene-product group is intended for.

For this purpose, in the central control means 27, for example at the beginning of the production process, each holder of the grouping conveyor 16 is assigned an identifier which identifies the respective machine A-D for which the contents of the holder is intended. This assignment is stored in a suitable memory.

In addition, each of these respectively associated holders has calculated for it the number of hygiene products 11 which the filling mechanism S is intended to introduce into the respective bag.

Within the context of implementing this measure, it is possible to generate, for each holder of the grouping conveyor 16, a specified value for the number of hygiene products 11 which are to be introduced into the holder. These specified values can be communicated to the control unit 15 of the filling mechanism S, the latter carrying out the filling operation accordingly.

The calculation of the number of products provided in each case for the respective holder takes account of the fact that usually the group of hygiene products 11 which is subsequently to be contained in a packaging unit 21-24 generated by one of the packaging machines A-D is divided up between a plurality of holders of the grouping conveyor 16 which are arranged one after the other in the conveying direction. In other words, the group of products contained in the finished pack 21-24 is made up usually of sub-groups of hygiene products 11 which have been introduced into the individual holders. The operation of dividing up the hygiene products 11 between the individual holders, taking account of the different machines A-D and of the various sizes of multipack which the machines A-D produce, tends to be a complex task. This is performed preferably by the central control device 27.

Figure 2:
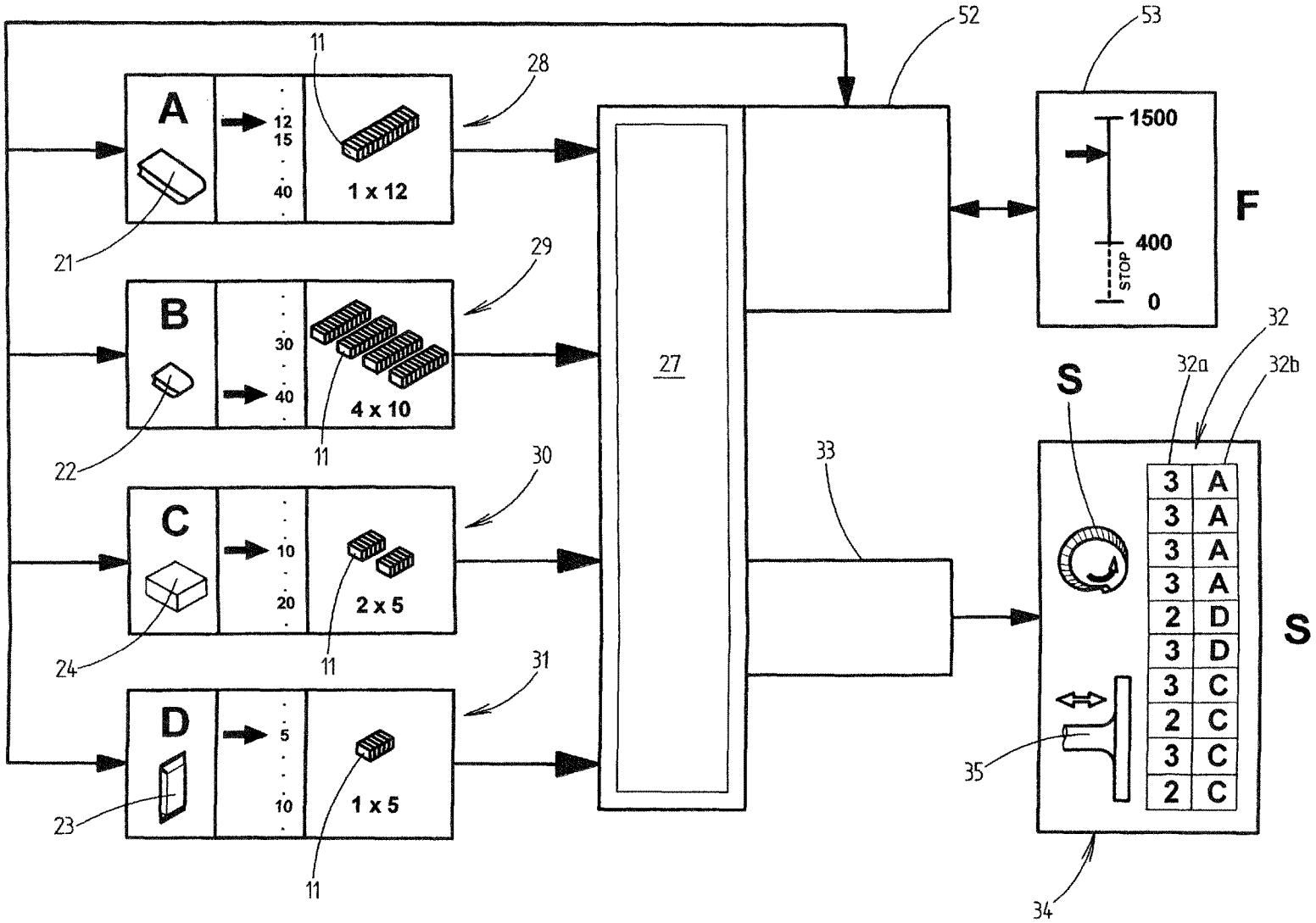
FIG. 2 shows an overview of an operation according to the invention involving filling holders or compartments of a grouping conveyor of the production and packaging installation.

In the exemplary embodiment corresponding to FIG. 2, the packs 21, which are produced by the packaging machine A, comprise twelve hygiene products 11. Accordingly, the central control means 27 communicates the value twelve, for the size of the pack which is to be produced, to the local control means 17, see control block 28 in FIG. 2.

The packs 22 produced by the packaging machine B comprise in each case groups of four times ten hygiene products 11, see control block 29. In other words, forty hygiene products 11 are contained in a pack 22.

The packaging machine C produces packs 24 which are contained in groups of two times five hygiene products 11 in the packs 24. Accordingly, a total of ten hygiene products 11 are integrated in the respective packs 24, see control block 30.

Finally, the packaging machine D produces packs 23 containing five hygiene products 11, see control block 31.

These values and performance or speed values which are known from the individual packaging machines A-D, and relate to the number of hygiene products 11 which can be packaged per unit of time by the respective machine A-D, or to the number of packaging units 21-24 which can be produced in each case per unit of time, are used, by the control means 27, to calculate a sequence for the operation of filling the holders of the grouping conveyor 16, that is to say a sorting pattern 32, see control block 34. It is also possible for the sorting pattern 32 already to have been stored in the control means at the beginning of the production process. During the production process, the holder of the grouping conveyor 16 is then filled with reference to the sorting pattern 32.

The sorting pattern 32 comprises, in general terms, for all of the holders, the number of hygiene products 11 with which a certain holder is to be filled and also the identifier of the machine for which the respective holder is intended.

FIG. 2 illustrates part of the sorting pattern 32 in table form, that is to say with two columns and a number of lines corresponding to the number and the sequence of holders in the grouping conveyor 16. Accordingly, each line is assigned to a respective holder of the grouping conveyor 16. The holders which are arranged immediately one after the other in the conveying direction, or the successive holders, are symbolized in this way from top to bottom.

Each cell in the left-hand column **32*a* of the sorting pattern 32 contains the value denoting in each case the number of hygiene products 11 which is contained in the respectively associated holder of the grouping conveyor 16. The cells in the right-hand column 32*b*** contain the value denoting an identifier representative of the respective machine A-D, for example the machine address.

For example the upper four lines of the sorting pattern 32 show that the four holders of the grouping conveyor 16 which are assigned correspondingly to the lines, and are arranged one after the other in the conveying direction, are assigned to the packaging machine A. In other words, the contents of said holders are intended for the packaging machine A. In the present case, in each case three hygiene products 11 are contained in each holder. Accordingly, a total of four holders each with three hygiene products 11 are assigned to the packaging machine A. These four holders with the respectively three hygiene products 11 give the total number of twelve hygiene products 11 contained in each packaging unit 21. In other words, the product group of twelve hygiene products 11 which is to be integrated in the pack 21 is divided up into four equal sub-groups of in each case three hygiene products 11 between the aforementioned four holders.

The lines which follow on directly below the four aforementioned lines in the table of the sorting pattern 32 show that the two holders assigned to said lines are assigned to the machine D. As can be seen from the table, the respectively two and three hygiene products 11, a total of five hygiene products 11, are located in each case in the associated holders. These five hygiene products 11 are integrated, in the form of pack contents, in the packs 23 produced by the machine D.

The next lines to follow directly beneath show the next-following holders, which are assigned to the machine C, to be precise with the product-number sequence 3, 2, 3, 2. This gives a total of ten products corresponding to the multipack size of the packs 24 produced by the machine C.

A pushing-out means 35 is also symbolized in the control block 34. Said pushing-out means is representative of the removal devices which have already been mentioned above and by means of which in each case the individual contents of the holders of the grouping conveyor 16 can be removed from the holders, in the region of the respective removal station assigned to the respective machine A-D, and fed to the corresponding packaging machine A-D.

As can clearly be seen, each packaging machine A-D can have predetermined for it an operation for filling the holders of the grouping conveyor 16 which is adapted individually to the respective packaging machine and/or to the respective type of pack produced by the machine. This makes it possible for a plurality of packaging machines A-D to be assigned to one and the same grouping conveyor 16 and/or to one and the same production machine F.

It is thus possible, in the production and packaging installation 10, for in each case different types of pack with different numbers of hygiene products 11 of the same kind contained therein to be produced. Without this individually coordinatable and/or variable bag-filling operation or sorting pattern 32, it would be necessary for all of the machines arranged on the grouping conveyor 16 to have in each case the same number of holders and the same number of hygiene products 11 contained in the holders.

The calculation for the sorting pattern 32 can take place, for example, once prior to the beginning of production. During production, however, automatic adaptation of the sorting pattern 32 is also possible.

For example in the event of one of the packaging machines A-D in the production process failing, the control means 27 can adapt the sorting pattern 32 automatically. None of the holders is then still assigned to the failed machine as production progresses. Correspondingly, filling of the holder then takes place only with reference to the new sorting pattern 32, that is to say in relation to the rest of the packaging machines A-D, which have not failed.

Provision may also be made here for already filled holders, of which the contents have already been assigned to a certain machine A-D, are assigned, immediately following failure of said machine A-D, to the remaining, functional machines A-D. Of course, this is possible only if the filling of the holders with hygiene products 11 which was provided for the failed machine A-D is also appropriate for the functional machine A-D and/or for the pack 21-24 produced thereby.

If this is not the case, the aforementioned hygiene products 11 accommodated, immediately following the machine failure, in the holders assigned to the failed machine A-D are ejected as defective products.

Figure 3:
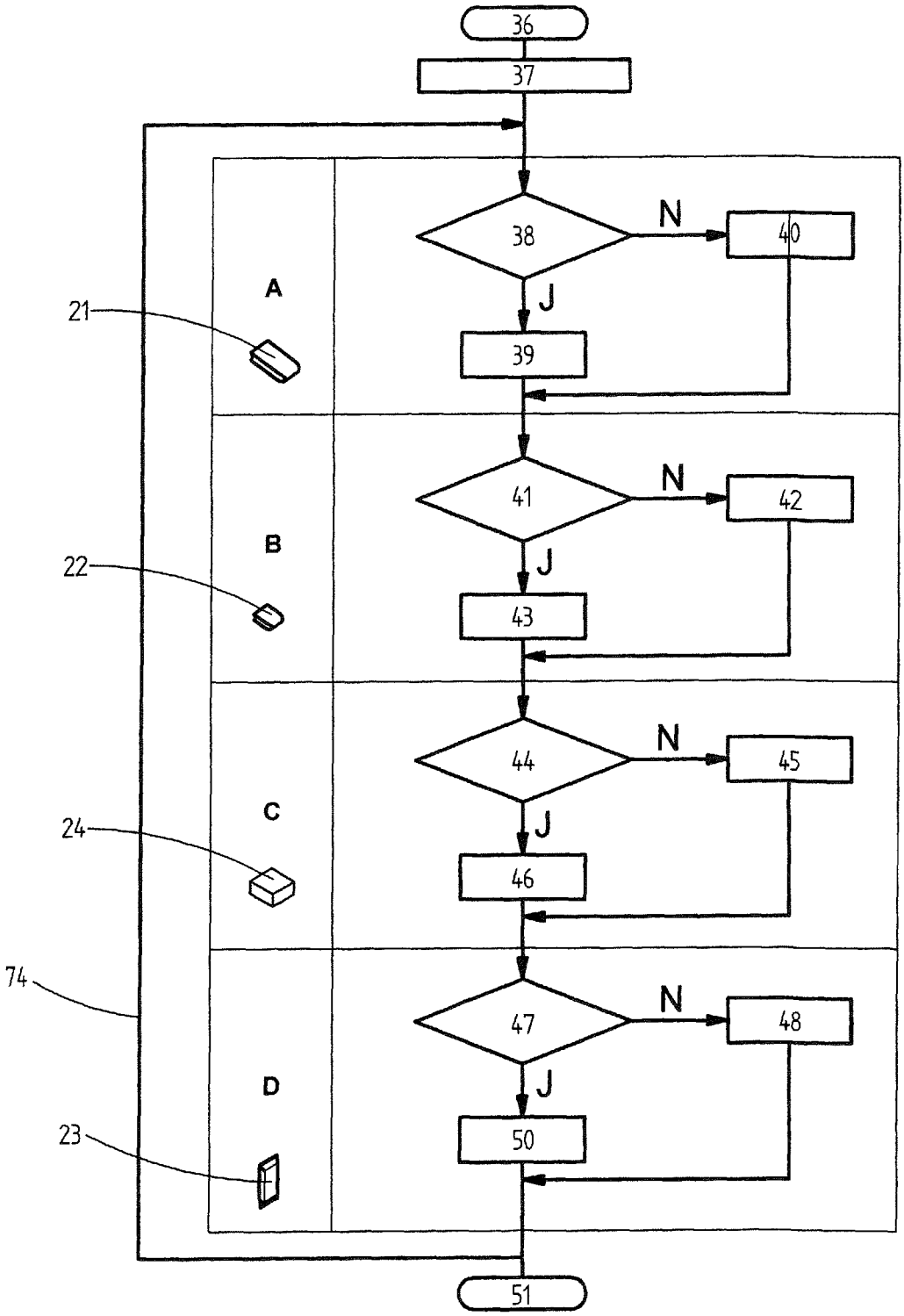
FIG. 3 shows a further flow diagram which allows visualization of a calculation of the compartment-filling operation according to the invention.

FIG. 3 symbolizes, in a highly simplified illustration, a further possible procedure within the context of carrying out the calculation for the holder filling and/or the sorting pattern 32.

The beginning of the calculation is represented by the symbol (36). Following, or at, the start of production (36), an interrogation is made, in a first step, as to whether the packaging machine A is ready (38). If this is the case (Y=yes), the sorting pattern 32 of the holders of the grouping conveyor 16 is calculated to take account of the machine A (39).

If the machine A is not ready (N=no), for example on account of a fault or a failure of the same, the sorting pattern is set to a zero value (40).

Similarly, an interrogation is made, in the next step, as to whether the machine B is ready for operation (41). If not (N), the sorting pattern calculated up until that point is maintained (42). If the machine B, in contrast, is ready for operation, the sorting pattern is calculated anew (43). The calculation then takes account of the fact that (possibly also) the machine B is ready for operation.

In the next step, it is checked whether the machine C is ready for operation (44). If not (N), the sorting pattern calculated up until that point is maintained (45). If the machine C is ready for operation (Y), the sorting pattern is calculated anew, to be precise taking account (possibly also) of the machine C (46).

In an equivalent manner, an interrogation is made as to whether the machine D is ready for operation, and the sorting pattern is possibly calculated anew (steps 47, 48, 50).

Step (51) symbolizes the end of the calculation. As the arrow 74 symbolizes, it is possible for the interrogations and for the calculation to be repeated a number of times during the process, for example at predetermined time intervals.

As already mentioned above, the calculation is started anew in particular as soon as one of the machines A-D communicates a fault or failure or communicates in general terms that it is no longer ready for operation.

A further particularly important method for operating the production and packaging installation 10 relates to the adjustment of the current, individual packaging performance or packaging speed of the individual machines A-D.

The performances of the machines A-D of the machine group are adjusted automatically, by the central control device 27, in accordance with the current production performance of the production machine F and/or in accordance with the individual, in each case currently available production and packaging performances of the packaging machines A-D of the machine group.

In FIG. 2, the control block 52 symbolizes this method for controlling the performances of the individual machines A-D. As can be seen, the current performance of the production machine F enters into the control means and/or adjustment of the respective performances of the machines A-D. Conversely, possibly in dependence on the available performance of the machines A-D, it is also the case that the current performance of the production machine is adjusted to a certain value.

For example for the case where the performance of one of the packaging machines A-D, for example of the packaging machine A, has been reduced, for example to the value zero, as a result of a fault, the control device 27 ensures that the rest of the machines B-D increase their performances in each case such that the performance drop of the machine A is compensated for overall.

It is preferably the case, during normal operation of the packaging machines A-D, that the respective performance thereof is adjusted automatically, in accordance with the performance of the production machine F, to the smallest possible value at which it is ensured that all of the hygiene products 11 produced by the production machine F can be packaged by the operating packaging machines A-D.

It is also the case that, whenever the maximum-adjustment performances of the packaging machines A-D are insufficient for packaging the hygiene products 11 which come from the production machine F at the currently set level of performance of the production machine F, the performance of the production machine F is reduced automatically to a value at which it is possible for all of the hygiene products 11 produced to be packaged properly into the corresponding packaging units 21-24. It is preferred here to set the largest possible performance value for the production machine F at which said condition is met.

As has already been mentioned above, for this purpose, in the first instance the current performances or performance values of the machines A-D are interrogated and communicated to the central control device 27. The central control device 27 can then calculate, for example in dependence on the values interrogated, specified performance values for the individual packaging machines and/or for the production machine F. The specified performance values are then communicated, in the form of desired values, in each case to the local machine-control means 12, 15, 17-20.

Figure 4:
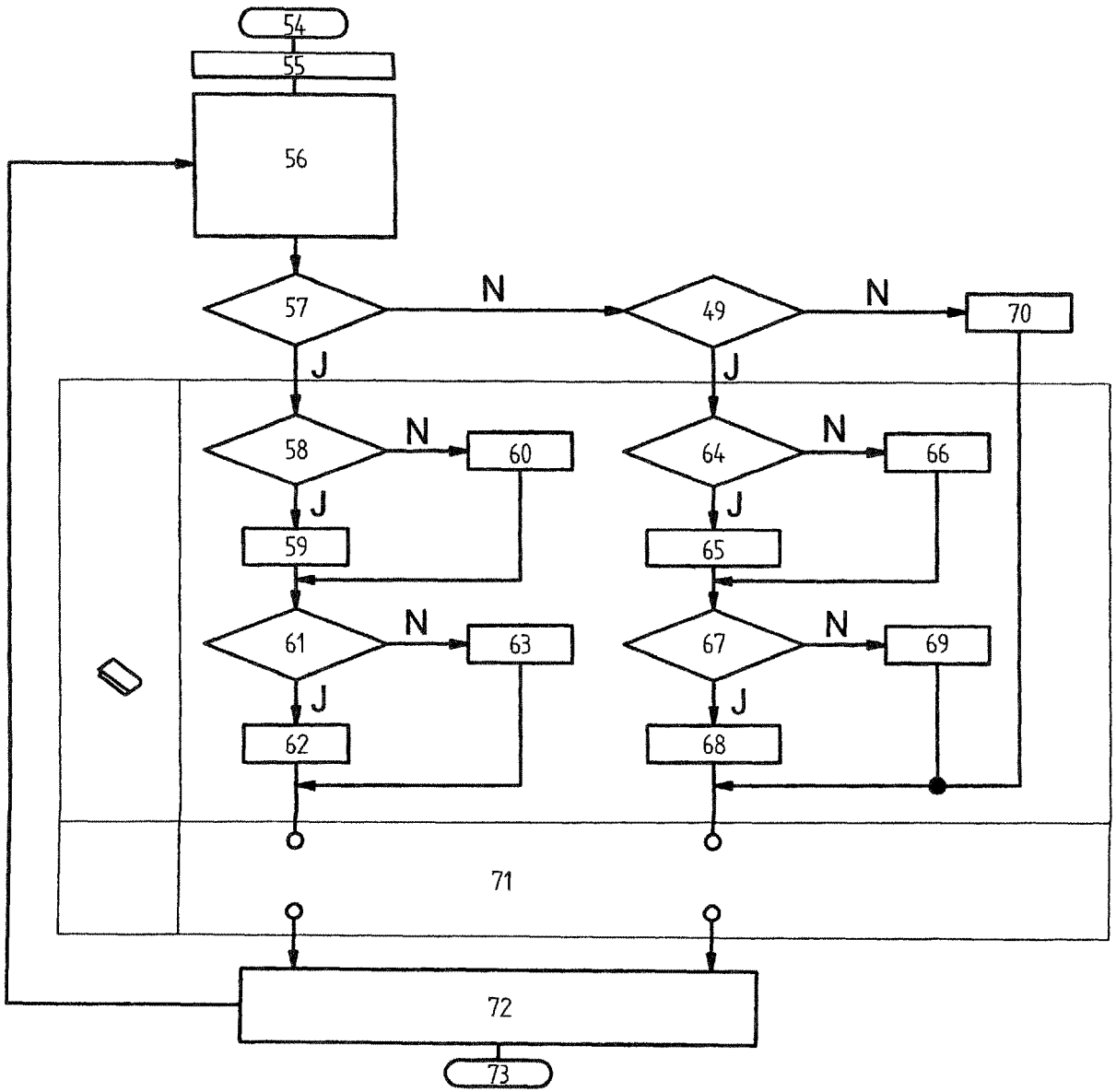
FIG. 4 shows a highly simplified flow diagram which allows visualization of the adaptation of the performances of the individual packaging machines of the production and packaging installation.

FIG. 4 shows, in abstract form, an example of a possible sequence for calculating and stipulating specified performance values for two packaging machines VPM1 and VPM2 (for example the packaging machines A and B) and for a production machine (for example the production machine F).

Following the beginning of the calculation (54) and following the start of production (55), inter alia interrogation and calculation of the following values takes place (56):

NormVel *VPM*1=speed of production machine/products per bag *VPM*1

NormVel *VPM*2=speed of production machine/products per bag *VPM*2

AverageVel=speed of production machine/Σ (products per bag *VPM*1; products per bag *VPM*2)

In step (57), first of all an interrogation is made as to whether the two machines VPM1 and VPM2 are ready for operation.

In the affirmative case (Y), an interrogation is made, in the next step (58), as to whether the speed or performance AverageVel, that is to say the average speed or average performance of the installation, calculated in packaging units per unit of time (for example 100 packaging units per minute), is smaller than the maximum or maximum-adjustment speed value of the machine VPM1. If this is the case (Y), the adjustable speed of the machine VPM1 is fixed first of all to said average installation speed (59). If this is not the case (N), the speed of the machine VPM1 is set to its maximum value (60).

Continuing to step (61), an interrogation is made as to whether the average speed of the installation is greater than the minimum or minimum-adjustment of the speed of the machine VPM1. In the affirmative case (Y), the speed of the machine VPM1 is set to the average speed of the installation (62). If not (N), the speed of the machine VPM1 is limited to its minimum possible speed (63).

If, however, the above interrogation (57) has shown that it is not the case that the two machines VPM1 and VPM2 are ready for operation at the same time (N), a machine must have failed.

An interrogation is then made, in step (49), as to whether the machine VPM1 is ready. If this is the case (Y), this means that VPM2 must have failed.

Continuing on, an interrogation is then made (64) as to whether NormVel VPM1 is smaller than the maximum-adjustment speed of the machine VPM1. The speed NormVel VPM1 here represents the packaging-unit-specific speed or performance of the machine VPM1 (for example eighty packaging units per minute).

If the interrogation has an affirmative response (Y), then, in the next step (65), the speed of the machine VPM1 is set to this standardized speed NormVel VPM1. If not (N), the speed of the machine VPM1 is set to the maximum possible or maximum-adjustment machine speed (66).

Continuing to step (67), an interrogation is made as to whether the average speed AverageVel of the installation is greater than the minimum-adjustment speed of the machine VPM1 (67). If this is the case (Y), the speed VPM1 is set to the standardized speed NormVel VPM1 (68). If this is not the case (N), the speed of the machine VPM1 is limited, or set, to the adjustable machine minimum (69).

If the above interrogation (63) had shown that VPM1 is not ready, the speed of the machine VPM1 is set to zero (70).

The processing block 71 symbolizes that all of the above interrogations and stipulations which have been described for the machine VPM1, and which result in the adjustable speed for the machine VPM1, are also carried out, in an analogous or equivalent manner, for the next machine VPM2.

For the case where there are yet further machines contained in the machine group, corresponding steps are also carried out for the further machines.

At the end of the processing block 71, it is then the case, accordingly, that both the adjustable speed of the machine VPM1 and the adjustable speed VPM2 are fixed.

These values are then used, in the processing block 72, to calculate the maximum possible production speed of the production machine.

This can be done using the formula:

Speed *VPM*1*products per bag *VPM*1+speed *VPM*2*products per bag *VPM*2.

This maximum possible speed is then transferred, in the form of a specified performance value, to the production machine.

(72), finally, symbolizes the end of the sequence for calculating and stipulating the specified performance values for the machines VPM1, VPM2 and the production machine.

The aforementioned calculations and interrogations can take place a number of times in the production process, but in particular when one of the machines VPM1, VPM2 fails.

LIST OF DESIGNATIONS

| | |
|---|---|
| 10 | Production and packaging installation |
| 11 | Hygiene products |
| 12 | Control unit |
| 13 | Supply conveyor |
| 14 | Filling station |
| 15 | Control unit |
| 16 | Grouping conveyor |
| 17 | Control unit |
| 18 | Control unit |
| 19 | Control unit |
| 20 | Control unit |
| 21 | Pack |
| 22 | Pack |
| 23 | Pack |
| 24 | Pack |
| 25 | Compressing device |
| 26 | Compressing device |
| 27 | Central control device |
| 28 | Control block |
| 29 | Control block |
| 30 | Control block |
| 31 | Control block |
| 32 | Sorting pattern |
| 32a | Left-hand column |
| 32b | Right-hand column |
| 33 | Control block |
| 34 | Control block |
| 35 | Pushing-out means |
| 36-51 | Flow-diagram symbols |
| 52 | Control block |
| 53 | Control block |
| 54-74 | Flow-diagram symbols |
| A | Packaging machine |
| B | Packaging machine |
| C | Packaging machine |
| D | Packaging machine |
| F | Production machine |
| S | Filling mechanism |

The invention claimed is:

1. A method for operating a production and packaging installation (10) for hygiene products (11) in which the hygiene products (11) are produced, the production and packaging installation (10) comprising a grouping conveyor (16) assigned to a machine group comprising a plurality of packaging machines (A-D), the method comprising:

producing the hygiene products (11) in a unit for producing the hygiene products (11);

supplying individually the hygiene products (11) produced by the unit for producing the hygiene products (11), one after the other, to the grouping conveyor (16) which has individual holders for the hygiene products (11);

filling a respective one of the individual holders with either (a) one of the hygiene products (11) or (b) a hygiene-product group comprising a plurality of the hygiene products (11);

assigning at least one of the individual holders to one of the plurality of packaging machines (A-D);

removing the one of the hygiene products (11) or the hygiene-product group from the respective one of the individual holders in which it is located by pushing the one of the hygiene products (11) or the hygiene-product group from the respective one of the individual holders into one of the plurality of packaging machines (A-D), thereby supplying the one of the hygiene products (11) or the hygiene-product group to the one of the plurality of packaging machines (A-D); and then;

packaging (a) the one of the hygiene products (11) or the hygiene-product group from one of the individual holders together with (b) at least another of the one of the hygiene products (11) or another of the hygiene-product groups from another of the individual holders into a pack (21-24), wherein, prior to the filling operation, each of the individual holders is automatically assigned in each case to one of the plurality of packaging machines (A-D) such that the one of the hygiene products (11) or the hygiene-product group located in the one of the individual holders assigned to the one of the plurality of packaging machines (A-D) is subsequently fed to the one of the plurality of packaging machines (A-D), wherein the individual holders are filled with a number of the hygiene products (11) selected automatically for each of the individual holders in dependence on which of the one of the plurality of packaging machines (A-D) (a) the one of the hygiene products (11) or the hygiene-product group from the one of the individual holders together with (b) the at least another of the one of the hygiene products (11) or the another of the hygiene-product groups from the another of the individual holders is intended for, wherein at least two of the plurality of packaging machines (A-D) are assigned to the unit for producing the hygiene products (11), wherein at least one of the plurality of packaging machines (A-D) packages (a) the one of the hygiene products (11) or the hygiene-product group from one of the individual holders together with (b) the at least another of the one of the hygiene products (11) or the another of the hygiene-product groups from the another of the individual holders into the pack (21-24) which, in respect of the number of the hygiene products (11) contained therein, differ from the pack (21-24) of at least one other of the plurality of packaging machines (A-D) and wherein, during the filling of the individual holders, the number of the hygiene products (11) provided in the pack (21-24) is automatically divided up between a plurality of the individual holders, in dependence on the number of the hygiene products (11) to be contained in the pack (21-24).

2. The method as claimed in claim 1, further comprising, in the event of one of the plurality of packaging machines (A-D) failing, assigning each of the individual holders assigned to the failed one of the packaging machines (A-D) to another one of the plurality of packaging machines (A-D).

3. The method as claimed in claim 2, further comprising feeding the hygiene products (11) or the hygiene-product groups currently assigned to the failed one of the packaging machines (A-D) to the another one of the plurality of packaging machines (A-D).

4. The method as claimed in claim 1, further comprising automatically adapting the performances of the plurality of packaging machines (A-D) in accordance with at least one from a group consisting of the performance of the unit for producing the hygiene products (11) and in accordance with the individual performances of the plurality of packaging machines (A-D).

5. The method as claimed in claim 4, further comprising, where the performance of one of the plurality of packaging machines (A-D) has been, or is being, reduced, the respective performance of one or any other of the plurality of packaging machines (A-D) is increased automatically in order to compensate for the performance reduction.

6. The method as claimed in claim 4, further comprising, during normal operation of the plurality of packaging machines (A-D), the performance of the plurality of packaging machines (A-D) is adjusted automatically, in accordance with the performance of the unit for producing the hygiene products (11), to the smallest value where all of the hygiene products (11) produced by the unit for producing the hygiene products (11) are packaged by the plurality of packaging machines (A-D) assigned to the grouping conveyor (16).

7. The method as claimed in claim 4, further comprising, where the maximum-adjustment performances of the plurality of packaging machines (A-D) assigned to the grouping conveyor (16) are insufficient for packaging all of the hygiene products (11) coming from the unit for producing the hygiene products (11) at the given level of performance of the unit for producing the hygiene products (11), the performance of the unit for producing the hygiene products (11) is reduced automatically to a value at which all the hygiene products (11) produced is packaged.

8. The method as claimed in claim 4, further comprising sensing and communicating the current performances of each of the plurality of packaging machines (A-D) and the current performance of the unit for producing the hygiene products (11) to a central control device (27) of the installation (10), and, in dependence on the values sensed, the central control device (27) determines performance values for the plurality of individual packaging machines (A-D) and for the unit for producing the hygiene products (11).

9. The method as claimed in claim 8, further comprising communicating the performance values in each case to local machine-control means (12, 15, 17-20) that are assigned in each case to each of the plurality of packaging machines (A-D) and the unit for producing the hygiene products (11).

10. The method as claimed in claim 1, wherein the unit for producing the hygiene products (11) is a production machine (F).

11. A production and packaging installation for a hygiene product packaging operation, comprising:

a unit for producing hygiene products (11);

a plurality of packaging machines (A-D) for packaging the hygiene products (11);

a grouping conveyor (16) which has individual holders for the hygiene products (11), and to which the plurality of packaging machines (A-D) are assigned, and to which the hygiene products (11) produced by the unit for producing the hygiene products (11) is supplied individually, and one after the other, prior to the packaging operation;

a control device (27) for automatically selecting a number of the hygiene products (11) with which the individual holders of the grouping conveyor (16) are to be filled, for each of the individual holders, in dependence on which of the plurality of packaging machines (A-D) the hygiene products (11) are intended for, wherein the plurality of packaging machines (A-D) are assigned to the grouping conveyor (16) to form a machine group, wherein at least two of the plurality of packaging machines (A-D) are assigned to the unit for producing the hygiene products (11), wherein a respective one of the individual holders is filled with either (a) one of the hygiene products (11) or (b) a hygiene-product group comprising a plurality of the hygiene products (11), wherein, prior to the filling operation, each of the individual holders is automatically assigned in each case to one of the plurality of packaging machines (A-D) such that the one of the hygiene products (11) or the hygiene-product group located in the one of the individual holders assigned to the one of the plurality of packaging machines (A-D) is subsequently fed to the one of the plurality of packaging machines (A-D), wherein the one of the hygiene products (11) or the hygiene-product group is configured to be removed from the respective one of the individual holders and is further configured to be pushed to the one of the plurality of packaging machines (A-D) to which the one of the hygiene products (11) or the hygiene-product group is assigned, wherein the one of the plurality of packaging machines (A-D) packages (a) the one of the hygiene products (11) or the hygiene-product group from one of the individual holders together with (b) at least another of the one of the hygiene products (11) or another of the hygiene-product groups from another of the individual holders into a pack (21-24) which, in respect of the number of the hygiene products (11) contained therein, differ from the pack (21-24) of at least one other of the plurality of packaging machines (A-D), and wherein, during the filling of the individual holders, the number of the hygiene products (11) provided in the pack (21-24) is automatically divided up between a plurality of the individual holders, in dependence on the number of the hygiene products (11) to be contained in the pack (21-24).

12. The production and packaging installation as claimed in claim 11, wherein the hygiene products (11) are conveyed individually, and one after the other, in the direction of the grouping conveyor (16) by means of a feed conveyor (13), wherein the individual holders of the grouping conveyor (16) are filled, by means of a filling mechanism (S), with the hygiene products (11) coming from the feed conveyor (13).

13. The production and packaging installation as claimed in claim 12, wherein the performances of the plurality of packaging machines (A-D) are adapted automatically in accordance with the performance of the unit for producing the hygiene products (11) and in accordance with the individual performances available for the plurality of packaging machines (A-D).

14. The production and packaging installation as claimed in claim 12, wherein the individual holders of the grouping conveyor (16) are filled so as to form the hygiene-product groups.

15. The production and packaging installation as claimed in claim 11, wherein the performances of the plurality of packaging machines (A-D) are adapted automatically in accordance with the performance of the unit for producing the hygiene products (11) and in accordance with the individual performances available for the plurality of packaging machines (A-D).

16. The production and packaging installation as claimed in claim 11, wherein (a) the one of the hygiene products (11) or the hygiene-product group from one of the individual holders is packaged together with (b) the at least another of the one of the hygiene products (11) or the another one of the hygiene-product groups from the another one of the individual holders into the pack (21-24).

* * * * *